United States Patent [19]

Fricker

[11] Patent Number: 5,074,442

[45] Date of Patent: Dec. 24, 1991

[54] REFRACTORY PLATE UNIT WITH ANNULAR CENTERING SURFACE AND SLIDING CLOSURE UNIT ASSEMBLY INCORPORATING THE SAME

[75] Inventor: Robert Fricker, Unterägeri, Switzerland

[73] Assignee: Stoping AG, Baar, Switzerland

[21] Appl. No: 620,438

[22] Filed: Nov. 30, 1990

Related U.S. Application Data

[63] Continuation of Ser. No. 295,523, Jan. 10, 1989, abandoned.

[30] Foreign Application Priority Data

Jan. 15, 1988 [CH] Switzerland ..... 142/88-4

[51] Int. Cl.[5] ..... B22D 41/28

[52] U.S. Cl. ..... 222/600

[58] Field of Search ..... 222/600, 591, 597; 266/236, 287

[56] References Cited

U.S. PATENT DOCUMENTS

| | | | |
|---|---|---|---|
| 4,182,466 | 1/1980 | Fehling et al. | 222/600 |
| 4,566,925 | 1/1986 | Schnabel et al. | 222/600 |
| 4,729,497 | 3/1988 | Fricker | 222/600 |
| 4,763,881 | 8/1988 | Wenger | 222/600 |

FOREIGN PATENT DOCUMENTS

| | | |
|---|---|---|
| 3526083 | 2/1987 | Fed. Rep. of Germany . |
| 2255126 | 7/1975 | France . |
| 2369042 | 5/1978 | France . |
| 2398568 | 2/1979 | France . |

*Primary Examiner*—S. Kastler

*Attorney, Agent, or Firm*—Wenderoth, Lind & Ponack

[57] ABSTRACT

A refractory plate unit for use as a sliding plate or as a stationary plate in a sliding closure unit at an opening of a metallurgical vessel includes a refractory plate having therethrough a discharge opening. A metal member is rigidly attached to the refractory plate and has an annular surface centered radially outwardly of the discharge opening and mating with substantially no free play with a complementary surface of a metal frame supporting the refractory plate unit.

27 Claims, 3 Drawing Sheets

REFRACTORY PLATE UNIT WITH ANNULAR CENTERING SURFACE AND SLIDING CLOSURE UNIT ASSEMBLY INCORPORATING THE SAME

This application is a continuation of now abandoned application, Ser. No. 07/295,523 filed on Jan. 10, 1989 now abandoned.

BACKGROUND OF THE INVENTION

The present invention relates to a refractory plate unit and to a sliding closure unit assembly incorporating such refractory plate unit. More particularly, the present invention relates to such unit and assembly to be incorporated into a sliding closure unit or slide gate valve for controlling the discharge of molten metal from a discharge spout of a metallurgical vessel. Further particularly, the present invention is directed to such a unit and assembly wherein the refractory plate unit includes at least one metal band or member therearound and has therethrough at least one discharge opening. Still more particularly, the present invention relates to such a unit and assembly wherein the refractory plate unit is inserted loosely into a metal frame of the sliding closure unit assembly, i.e. without the need for positioning the refractory plate unit within the metal frame by means of clamping or locking mechanisms.

In known sliding closure units it has been conventional to mount a refractory plate or refractory plate unit in a metal frame by means of clamping or locking mechanisms. Such arrangement however has the disadvantage that removal and replacement of the refractory plate unit is a difficult and time consuming matter. This disadvantage is overcome in accordance with one known arrangement, disclosed in DE-OS 22 27 501, wherein a refractory plate unit is mounted within a metal frame without clamping or locking mechanisms, i.e. a so-called loose insertion or mounting. This known arrangement has the advantage that the refractory plates, that are subjected to very severe wear, can be removed and replaced in a more simple operation without the need for clamping tools. Additionally, this known arrangement has the further advantage that the loose insertion or mounting of the refractory plates prevents or substantially reduces, the formation of stress cracks in the plate that can occur due to thermal expansion when a refractory plate is firmly and fixedly clamped in position. However, this known arrangement suffers from certain inherent disadvantages. Thus, production of refractory plates inevitably requires production tolerances of up to several millimeters over the length and width of the refractory plates. This is due to firing of the plates as well as for other reasons that would be understood by one skilled in the art. For economical reasons it is not practical to machine the plates or to machine an entire metal shell often employed to surround the plates. Thus, there is the risk that the refractory plate unit, or a refractory plate unit and an accompanying refractory spout sleeve, will be inserted into the metal frame with several millimeters tolerance therebetween. Accordingly, when the refractory plate unit or the metal frame supporting the refractory plate unit is moved, there will occur relative movement therebetween. The refractory plate and the adjoining spout sleeve often are built as a unit, since when the sleeve is inserted separately mortar between the refractory plate and the sleeve can be destroyed due to such relative movement. Consequently, there exists the danger that the molten metal can break through such destroyed mortar. On the other hand, with regard to a stationary refractory plate and a stationary spout sleeve, the sleeve is rapidly worn and eroded during use. The stationary plate and stationary sleeve normally are joined by an interlocking depression and projection. However, when it becomes necessary to change the plates frequently, proper centering no longer can be achieved reliably. Therefore, the sleeve also must be frequently replaced despite the difficulty in such an operation.

SUMMARY OF THE INVENTION

Accordingly, it is an object of the present invention to provide an improved refractory plate unit and an improved sliding closure unit assembly incorporating the same whereby the refractory plate unit is loosely inserted within a metal frame of the assembly, but whereby it is possible to overcome the above and other disadvantages of known loose insertion or mounting arrangements.

It is a further object of the present invention to provide such a unit and assembly wherein loose insertion or mounting can be achieved in a simple manner providing reliable centering.

It is a still further object of the present invention to provide such a unit and assembly that achieves such advantages but yet is simple in operation and economical of manufacture.

These objects are achieved in accordance with the present invention by the provision of a unit and assembly for use as either a sliding plate or as a stationary plate in a sliding closure unit at an opening of a metallurgical vessel containing molten metal, wherein the refractory plate unit has therethrough a discharge opening, and a metal member rigidly attached to the refractory plate has an annular surface centered radially outwardly of the discharge opening and mating with substantially no free play with a complementary surface of a metal frame supporting the refractory plate unit. In accordance with the present invention, the refractory plate unit has a projection that is formed by a metal member having a machined cylindrical surface that is centered with respect to the flow opening or has a machined cylindrical exterior that is formed by the metal member and centered with respect to the flow opening.

Accordingly, in accordance with the present invention, the refractory plate unit can be manufactured in a very simple manner and can be assembled with a metal frame such that the discharge opening in the refractory plate always has a predetermined alignment with respect to the metal frame. The refractory plate unit of the present invention can be very simply manufactured since the annular surface, preferably cylindrical and machined, is made of metal, whereby during machining of the annular surface the existing discharge opening facilitates centering.

To center the refractory plate precisely in the metal frame, the cylindrical surface formed on the metal band is machined by desurfacing or, if a stamped metal shell is used, by a precise stamping operation. A diametrical tolerance of a few tenths of a millimeter at the cylindrical surface provides sufficient centering reliability.

Preferably, the axial dimension of the machined cylindrical surface of the metal member of the refractory plate unit is only a few millimeters so that the refractory plate unit readily can be inserted into and removed from the metal frame and does not have to be removed uniformly in the axial direction over a large mating dimension.

In one preferred arrangement, the refractory plate has a first axial projection having a round exterior and about which fits the metal member and a second laterally extending projection with the plate being centered and supported about the round projection, and outward yielding is made possible during operation of the unit and assembly during which, for example in the case of steel, the heat in the discharge region reaches up to approximately 1500° C. As a result, uniform distribution of thermal stress in the refractory part is possible, this resulting in an increased service life of the refractory plate.

The refractory plate unit having a cylindrical exterior centering the unit with respect to the metal frame preferably has a diametrical tolerance designed to enable the plate unit to be inserted in the metal frame with a sliding fit therebetween.

BRIEF DESCRIPTION OF THE DRAWINGS

Other objects, features and advantages of the present invention will be apparent from the following detailed description of preferred embodiments thereof, with reference to the accompanying drawings, wherein.

DETAILED DESCRIPTION OF THE INVENTION

Figure 1:
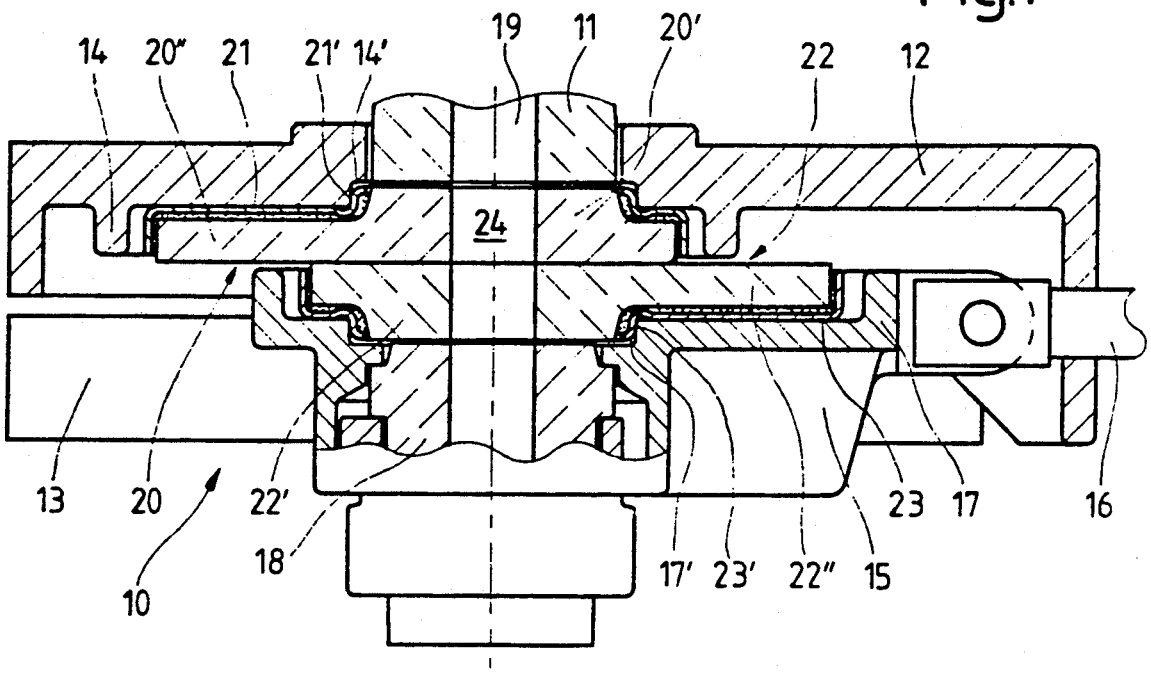
FIG. 1 is a longitudinal sectional view of a sliding closure unit incorporating refractory plate units and sliding closure unit assemblies in accordance with one embodiment of the present invention.

FIG. 1 illustrates one embodiment of the present invention incorporating a sliding closure unit or slide gate valve 10 including a stationary sliding closure unit assembly 12 and a movable sliding closure unit assembly 15. These assemblies include respective metal frames 14, 17 supporting respective refractory plate units 20, 22. Each refractory plate unit includes a respective refractory plate 20', 22' having therethrough a discharge opening 24 and an outer metal shell 21, 23 having mortared therein the respective refractory plate. Mortared to a planar surface of each refractory plate 20', 22' are an inlet refractory nozzle sleeve 11 having a discharge opening 19 and an outlet refractory nozzle sleeve 18, respectively. The movable assembly 15 is moved with respect to the stationary assembly 12 in a conventional manner, for example by a drive, not shown in detail and illustrated only by rod 16 in FIG. 1. Frame 13 is fixed to support the movable assembly 15 in a normal manner. The plate unit 22 is pressed upwardly against plate unit 20 in a known manner by means not shown so that abutting planar surfaces of the two plates are in sealing contact.

Figure 2:
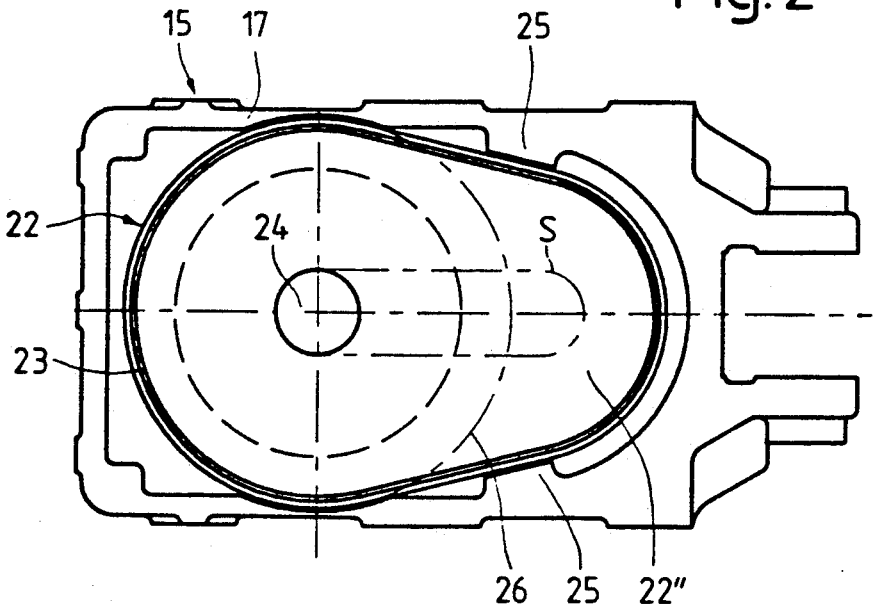
FIG. 2 is a top plan view of the movable assembly thereof.

In accordance with the present invention, the respective refractory plate units 20, 22 are mounted within their frames 14, 17, respectively, without clamping or locking mechanisms, i.e. the mounting of the plate units within the respective frames is of the loose insertion type. Each refractory plate 20', 22' has an axially extending first projection centered about the plate discharge opening. Each refractory plate also has a second laterally extending projection 20", 22". The respective metal shells 21, 23 are mortared about the peripheries of the plates, and each shell has an axially extending projection surrounding the respective first axial projections of the respective refractory plates. Each such shell projection has an exterior surface 21', 23' that is cylindrical and machined to a predetermined diametral tolerance about the discharge opening to a few tenths of a millimeter. These machines cylindrical surfaces mate with substantially no free play with complementary inwardly facing cylindrical surfaces 14', 17' of the respective metal frames. These cylindrical surfaces 14', 17' can be machined. By this arrangement, it is possible to center the respective plate units very precisely with respect to the discharge openings. It will be noted from FIG. 1 that the bores defining the surfaces 14', 17' are somewhat deeper in the axial dimension than the axial depth or dimension of the cylindrical surfaces 21', 23'. As shown in FIG. 2, the first axial projection of plate 22' has a circular exterior 26, and the second lateral projection 22" has a tapered decreasing dimension away from discharge opening 24 in the direction of movement of the movable assembly 15, such that the abutting surface of plate 22' will oppose the discharge opening 24 of the stationary plate 20' over an area S during use of the sliding closure unit. The refractory plate unit 22 is prevented from lateral twisting by means of stops 25 provided on frame 17. The stationary refractory plate unit 20 and the stationary metal frame 14 are of similar construction, however with the second refractory projection 20" of the stationary plate extending in a direction opposite to the projection 22" of the movable plate.

By the above arrangement of the present invention, the machined cylindrical surfaces 21', 23' are precisely centered about the discharge openings of the respective refractory plates. These machined cylindrical surfaces mate with substantially no free play with complementary cylindrical surfaces 14', 17' of the respective metal frames, and such surfaces also can be machined. This provides a very precise alignment of the plate units and at the same time enables relatively quick and simple replacement of the refractory plate units when necessary during operation of the sliding closure unit.

FIGS. 3–8 illustrate other embodiments of the present invention, and these figures illustrate refractory plate units and sliding closure unit assemblies that are movable. It is to be understood however that the stationary units and assemblies can be of the same construction.

Figure 3:
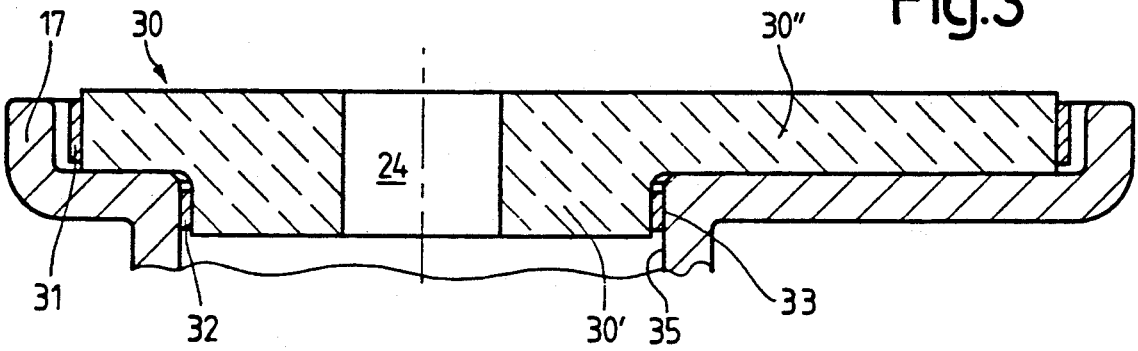
FIGS. 3–6, are partial longitudinal sectional views of further embodiments of movable refractory plate units and sliding closure unit assemblies in accordance with the present invention.

The assembly of FIG. 3 includes a refractory plate unit 30 including a refractory plate 30' having a first axial projection centered about discharge opening 24 and a metal member 32 heat shrunk about the outer surface of such axial projection. The outwardly facing surface 33 of metal member 32 is cylindrical and machined to be precisely centered about discharge opening 24. Surface 33 mates with substantially no free play with an inwardly facing surface 35 of metal frame 17. Surface 35 also can be machined. Another metal band 31 is heat shrunk around the outer periphery, including lateral projection 30", of the refractory plate in a normal manner. Since the outer surface 33 is machined to be precisely centered about discharge opening 24, it is possible to quickly and simply achieve a precise centering of the refractory plate unit. In an alternative arrangement, the outer surface of the axial first refractory projection of the refractory plate could be machined, and ring 32 could be heat shrunk therearound to thus obtain the required tolerance of the outer surface 33.

Figure 4:
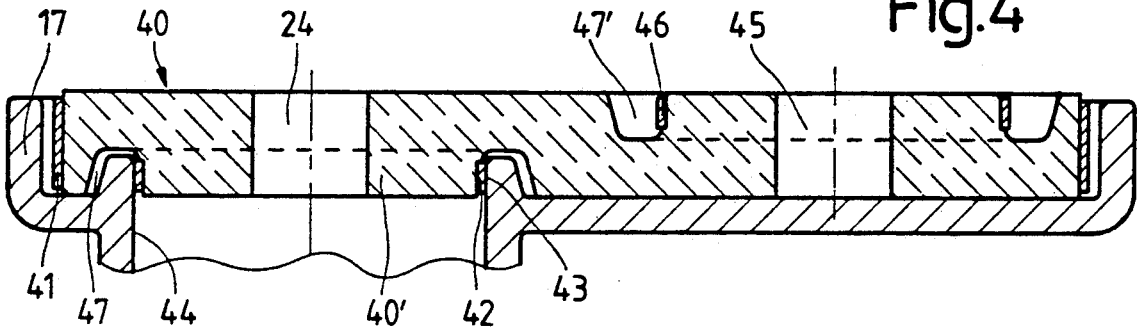

In the embodiment of FIG. 4 the refractory plate unit 40 includes a refractory plate 40' having two opposite planar surfaces. Furthermore, the refractory plate has therethrough two discharge openings 24, 45. Heat shrunk about the outer periphery of the refractory plate is a metal band 41. Formed in each of the opposite planar surfaces of the refractory plate, centered about a respective of the discharge openings 24, 45 is a respective annular groove 47, 47'. Each annular groove defines an outwardly facing surface having heat shrunk thereabout a metal member 42, 46 having a machined outer cylindrical surface, i.e. surface 43 with respect to metal member 42, precisely centered about the respective discharge opening. Machined surface 43 mates with substantially no free play with an inwardly facing surface 44 of a projection of frame 17 that extends upwardly into annular groove 47. The mating between cylindrical surfaces 43, 44 achieves a precise centering and positioning of the refractory plate. This arrangement of the refractory plate unit having two discharge openings has the advantage that when the opening 24 becomes worn, such worn opening and its groove 47 can be cemented shut by a refractory material that can be readily broken away, refractory material previously cemented in discharge opening 45 and annular groove 47' can be removed, and the plate can be turned over and used again as a replacement, thereby doubling the life of the plate unit. In this arrangement it is possible that the outer configuration of the plate unit can be in the shape of a figure eight, i.e. with two rounded plate parts. Such configuration however is exemplary only and not limiting to the present invention.

Figure 5:
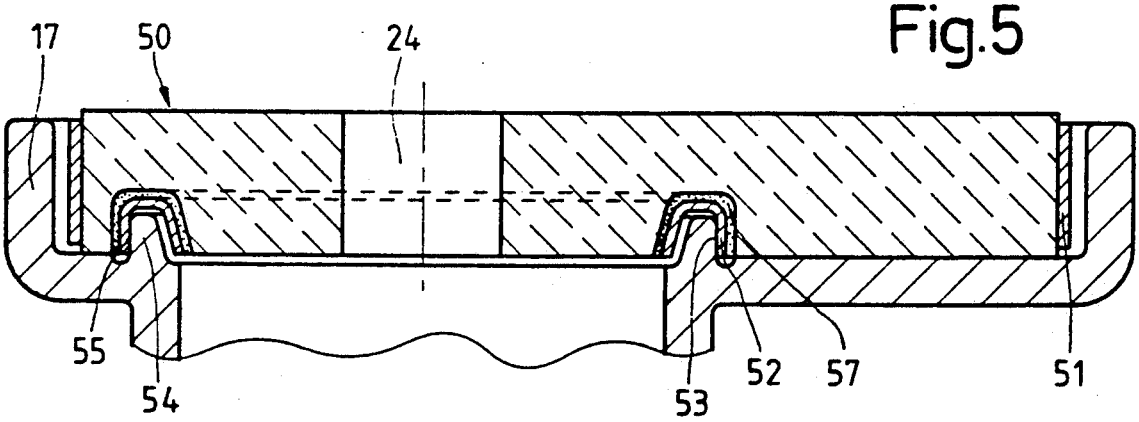

The embodiment of FIG. 5 shows a refractory plate unit 50 similar to that of FIG. 4, i.e. wherein the refractory plate has two opposite planar surfaces. FIG. 5 shows an annular groove 57 formed in only one surface, the plate having only a single discharge opening 24. It is to be understood however that this embodiment also, in a manner similar to the embodiment of FIG. 4, could have two discharge openings and two annular grooves. In this embodiment the metal member is in the form of an annular member 52 having a radial cross-sectional configuration of an inverted U-shape and defining an inwardly facing cylindrical surface 53 that is machined. Annular metal member 52 is mortared within annular groove 57. Machined surface 53 mates with substantially no free play with an outwardly facing surface 55 of a projection 54 of frame 17 that extends into the annular groove. Surface 53 is precisely centered about discharge opening 24, and the tight fit between surfaces 53, 54 provides for accurate positioning of the refractory plate unit. The refractory plate also has about the outer periphery thereof a heat shrunk metal band 51.

Figure 6:
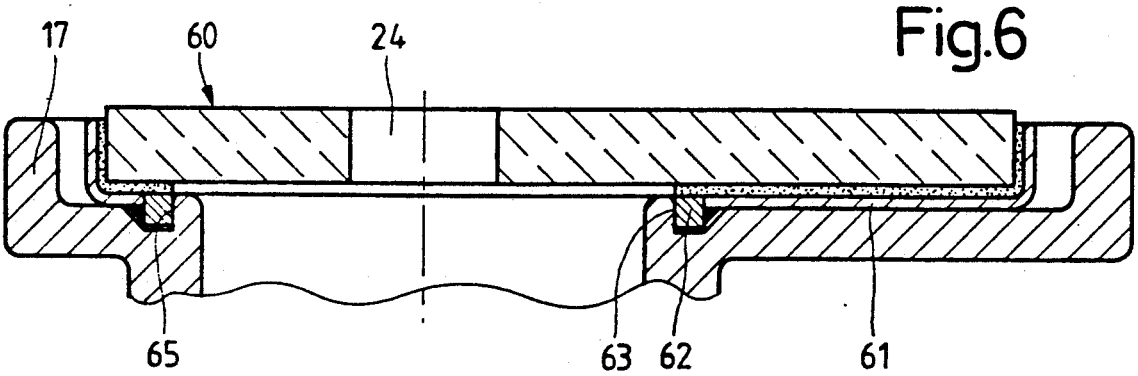

The refractory plate unit 60 of FIG. 6 includes a refractory plate having mortared thereabout a conventional metal shell 61. The metal member of the present invention is in the form of a metal ring 62 welded to metal shell 61 and having an inwardly facing surface 63 that is cylindrical and machined to be precisely centered about discharge opening 24. Surface 63 mates with substantially no free play with an outwardly facing surface 65 of frame 17.

Figure 7:
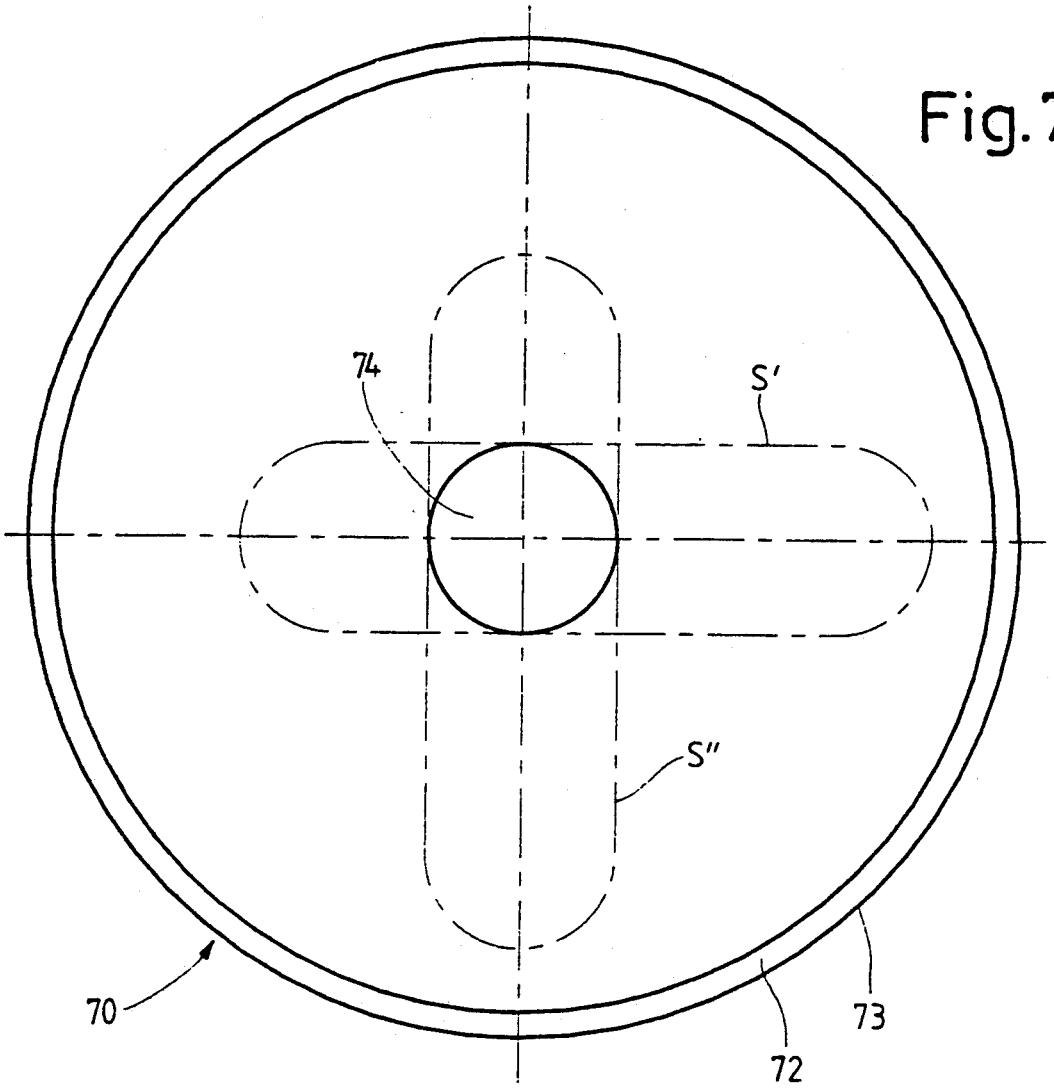
FIG. 7 is a plan view of a further embodiment of a refractory plate unit according to the present invention.
Figure 8:
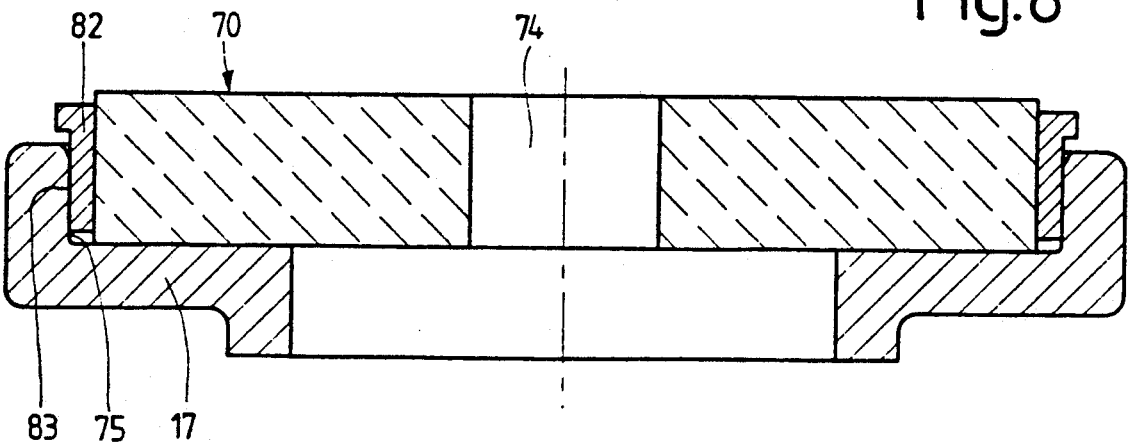
FIG. 8 is a longitudinal sectional view of a modification of the refractory plate unit of FIG. 7 and shown mounted in a metal frame.

FIG. 7 shows an embodiment of the present invention wherein the refractory plate unit 70 includes a circular refractory plate having therethrough a central discharge opening 74 and an outer periphery having heat shrunk thereon a metal band 72 that has an outer cylindrical machined surface 73 precisely centered about discharge opening 74. FIG. 8 illustrates a modification of this arrangement wherein the metal band 82 has an outer cylindrical machined surface 83 that extends axially over a portion only of the axial dimension of the metal band and plates with substantially no free play with a cylindrical surface of metal frame 17. By the provision of this arrangement it is easier to remove the plate unit 70 from the metal frame since it is centered over only a few millimeters of height. With the round refractory plate of the embodiments of FIGS. 7 and 8, as compared with the elongated refractory plate in the earlier discussed embodiments, the path of overlap with the discharge opening in the facing refractory plate (in the illustrated embodiment the stationary refractory plate S' may be caused to extend on opposite sides of the discharge opening 74. That is, the available surface area of the refractory plate is less in this embodiment than in the previous embodiments. This pattern may be achieved by, for example, moving the refractory plate unit in one direction to close the sliding closure unit and moving the unit in the opposite direction to achieve throttled discharge of molten metal. By such feature of the present invention the wear of the refractory plate is more uniformly distributed. As further illustrated in FIG. 7, the arrangement of a round plate unit has the advantage that the unit can be turned, for example by 90°, with respect to the metal frame to achieve a different wear patterns S''. This makes it possible to employ previously substantially unworn areas of the plate, thereby increasing the service life of the plate. The plate can be assured against twisting by simple lateral clamping.

In accordance with the present invention, centering of the plate units in the metal frames is guaranteed with a suitable operating reliability when, for example, the cylindrical surface of the plate unit has a diametral tolerance of from −0.1 to −0.3 millimeters, with the corresponding tolerance of the mating surface of the metal frame ranging from +0.1 to +0.2 millimeters.

It furthermore is to be understood that the term "discharge opening" as employed herein similarly can be intended to refer to an opening having therein a plug, such as a plug intended for injection of a gas. It furthermore is intended to be within the scope of the present invention to employ a two-part plate unit having one part without an opening.

Although the present invention has been described and illustrated with respect to preferred embodiments thereof, it is to be understood that various changes and modifications may be made to the specifically described and illustrated features without departing from the scope of the present invention.

I claim:

1. A refractory plate unit for use as a sliding plate or as a stationary plate in a sliding closure unit at an opening of a metallurigical vessel containing molten metal and capable of being mounted in a metal frame of the sliding closure unit in a loose insertion manner without clamping or locking mechanisms therebetween, said refractory plate unit comprising:

a refractory plate having therethrough a discharge opening; and a metal member rigidly attached to a portion of said refractory plate, said metal member having a circular annular surface, and one of said metal member and said portion of said refractory plate having a surface that is desurfaced or stamped at a precision sufficient to ensure that said circular annular surface of said metal member is centered precisely radially outwardly of said discharge opening and forming means adapted to mate with substantially no free play with a complementary surface of a metal frame intended to support and mount said refractory plate unit without the use of clamping or locking mechanisms therebetween.

2. A unit as claimed in claim 1, wherein said desurfaced or stamped surface is a desurfaced outer surface of said refractory plate, and said circular annular surface is an outer surface of said metal member heat shrunk about said outer machined surface of said refractory plate.

3. A unit as claimed in claim 1, wherein said desurfaced or stamped surface is said circular annular surface of said metal member.

4. A unit as claimed in claim 3, wherein said circular annular surface is a radially outwardly facing surface of said metal member.

5. A unit as claimed in claim 3, wherein said circular annular surface is a radially inwardly facing surface of said metal member.

6. A unit as claimed in claim 1, wherein said circular annular surface is cylindrical and extends axially of said discharge opening.

7. A unit as claimed in claim 6, wherein said cylindrical annular surface has an axial dimension less than the axial dimension of said metal member.

8. A unit as claimed in claim 1, wherein said portion of said refractory plate comprises a first projection extending axially of said discharge opening and having a circular exterior surface centered about said discharge opening, and said refractory plate has a second projection extending in a direction laterally of said discharge opening.

9. A unit as claimed in claim 8, wherein said metal member comprises a shell mortared about said refractory plate, said desurfaced or stamped surface is an outer surface of an axially projecting portion of said shell surrounding said first projection of said refractory plate, and said circular annular surface comprises said desurfaced or stamped outer surface.

10. A unit as claimed in claim 8, wherein said metal member comprises a band heat shrunk about said exterior surface of said first projection of said refractory plate.

11. A unit as claimed in claim 10, wherein said desurfaced or stamped surface and said circular annular surface comprise an outer surface of said band.

12. A unit as claimed in claim 10, further comprising an additional metal band heat shrunk about the outer periphery of said refractory plate including said second projection.

13. A unit as claimed in claim 1, wherein said refractory plate has opposite planar surfaces extending transverse to the axial direction of said discharge opening, and an annular groove formed in one said planar surface and centered about said discharge opening and defining an axial projection having a circular exterior surface, and said metal member is positioned within said groove.

14. A unit as claimed in claim 13, wherein said exterior surface of said axial projection is cylindrical, said desurfaced or stamped surface is an exterior surface of said metal member heat shrunk about said cylindrical exterior surface, and said circular annular surface comprises said desurfaced or stamped exterior surface.

15. A unit as claimed in claim 13, wherein said metal member is mortared within said annular groove and has an inverted U-shaped configuration in radial cross section.

16. A unit as claimed in claim 15, wherein said desurfaced or stamped surface is an inwardly facing surface of said metal member, and said circular annular surface comprises said desurfaced or stamped radially inwardly facing surface.

17. A unit as claimed in claim 13, wherein said refractory plate has therethrough two discharge openings, and each said planar surface has formed therein an annular groove centered about a respective one of said discharge openings.

18. A unit as claimed in claim 17, further comprising a plug fitted into one of said discharge openings.

19. A unit as claimed in claim 1, further comprising a metal shell mortared about said refractory plate, and wherein said metal member comprises a metal ring welded to said metal shell, said desurfaced or stamped surface is a radially inwardly facing surface of said metal ring, and said circular annular surface comprises said desurfaced or stamped radially inwardly facing surface.

20. A unit as claimed in claim 1, wherein said refractory plate has a circular periphery, said metal member is heat shrunk about said periphery, said desurfaced or stamped surface is a cylindrical outwardly facing surface of said metal member, and said circular annular surface comprises said desurfaced or stamped cylindrical outwardly facing surface.

21. A unit as claimed in claim 20, wherein said cylindrical annular surface has an axial dimension less than the axial dimension of said metal member.

22. A sliding closure unit assembly including said refractory plate unit as claimed in claim 1, and further comprising a metal frame having a circular annular surface mating with said circular annular surface of said metal member with substantially no free play and thereby supporting said refractory plate unit is a loose insertion manner without clamping or locking mechanisms therebetween.

23. A sliding closure unit assembly as claimed in claim 22, wherein said circular annular surface of said metal frame is cylindrical.

24. A sliding closure unit assembly as claimed in claim 23, wherein said cylindrical surface of said metal frame faces radially outwardly.

25. A sliding closure unit assembly as claimed in claim 23, wherein said cylindrical surface of said metal frame faces radially inwardly.

26. A sliding closure unit assembly as claimed in claim 23, wherein said cylindrical surface of said metal frame is machined.

27. A sliding closure unit assembly as claimed in claim 23, wherein said cylindrical surface of said metal frame and said mating circular annular surface of said metal member have diametrical tolerances such that said refractory plate unit can be inserted into said metal frame with a sliding fit therebetween.

* * * * *